United States Patent [19]

Nakashima et al.

[11] Patent Number: 4,700,177

[45] Date of Patent: Oct. 13, 1987

[54] SOUND GENERATING APPARATUS WITH SEALED AIR CHAMBER BETWEEN TWO SOUNDING PLATES

[75] Inventors: Toru Nakashima, Kariya; Haruhiko Inoue, Nagoya; Sigeki Furuta, Oobu, all of Japan

[73] Assignee: Nippondenso Co., Ltd., Kariya, Japan

[21] Appl. No.: 682,755

[22] Filed: Dec. 17, 1984

[30] Foreign Application Priority Data

Dec. 23, 1983 [JP] Japan ..... 58-242194

[51] Int. Cl.[4] ..... G08B 3/00

[52] U.S. Cl. ..... 340/388; 116/142 R; 181/163; 340/384 R; 340/384 E; 381/163

[58] Field of Search ..... 340/384 R, 384 E, 388, 340/391, 404; 116/59, 137 R, 142 R, 142 FP; 179/115 R, 110 A, 102, 115.5 H; 181/160, 163, 159, 177, 179, 182, 187, 189, 181, 183; 381/163, 191

[56] References Cited

U.S. PATENT DOCUMENTS

| | | | |
|---|---|---|---|
| 2,126,436 | 8/1938 | Williams . | |
| 2,202,467 | 5/1940 | Riesz | 340/388 |
| 3,055,451 | 9/1962 | Kenney | 181/156 |
| 3,721,840 | 3/1973 | Yamada | 179/110 A |
| 3,912,952 | 10/1975 | Kumon et al. | 179/110 A |
| 3,970,878 | 6/1976 | Berglund . | |
| 3,970,879 | 7/1976 | Kumon | 179/110 A |
| 4,159,472 | 6/1979 | Murakami et al. | 340/388 |
| 4,374,377 | 2/1983 | Saito et al. | 340/384 E |
| 4,409,588 | 10/1983 | Hofer et al. | 340/388 |
| 4,439,640 | 3/1984 | Takaya | 179/110 A |
| 4,486,742 | 12/1984 | Kudo et al. | 340/388 |
| 4,504,703 | 3/1985 | Schneiter et al. | 181/163 |
| 4,641,054 | 2/1987 | Takahata et al. | 340/384 E |

FOREIGN PATENT DOCUMENTS

| | | | |
|---|---|---|---|
| 1113288 | 12/1981 | Canada | 340/388 |
| 58-40717 | 9/1983 | Japan . | |

*Primary Examiner*—James L. Rowland
*Assistant Examiner*—Brent A. Swarthout
*Attorney, Agent, or Firm*—Cushman, Darby & Cushman

[57] ABSTRACT

A sound generating apparatus using piezoelectric elements includes first and second sounding plates arrayed in parallel with each other. The first and second sounding plates respectively include first and second diaphragms, and first and second thin plate-like piezoelectric elements laminated onto the first and second diaphragms. The first and second sounding plates are coupled together at the outer peripheral portions by a ring, thereby forming a hermetically sealed internal air chamber. The first and second sounding plates coupled together by the ring, and containing the internal air chamber cooperate to form a sounding member. The sounding member is supported by means of four resilient supporting members made of, for example, rubber, in a housing. In the housing, a front air layer and a rear air layer are formed on both sides of the sounding member, respectively. The front and rear air layers communicate with each other through a ringlike sound path. A plurality of sound passing holes are distributed closer to the outer periphery portion, while confronting the front air layer. A drive circuit applies a drive voltage signal in parallel to the first and second sounding plates.

15 Claims, 17 Drawing Figures

SOUND GENERATING APPARATUS WITH SEALED AIR CHAMBER BETWEEN TWO SOUNDING PLATES

BACKGROUND OF THE INVENTION

The present invention relates to a sound generating apparatus with a sounding body driven by a piezoelectric element, which is well adaptable for an alarm sounding device for use in an automobile, for example.

In the case of an alarm sounding device, such as a horn mounted to an automobile, 100 dB or more of sound pressure is required at a position 2 m from the horn. If the horn is constructed using a diaphragm driven by a piezoelectric element, the diameter of the diaphragm must be 90 mm or more. However, in constructing the piezoelectric element for driving the diaphragm, there is a limit to which the piezoelectric element can be increased. The maximum size permitted is 50 mm.

In constructing an alarm sounding device for an automobile by using a sounding body in which a piezoelectric element is attached to the diaphragm, using the second-order resonance of the diaphragm driven by a piezoelectric element has been proposed. In FIG. 1, for example, there is shown an arrangement of a conventional sound generating apparatus based on such a second-order resonance. A sounding plate 11 consists of a diaphragm 12 laminated with a piezoelectric element 13 shaped like a thin plate. The sounding plate 11 is fit to a first housing 14 to close an opening of the first housing 14. A second housing 15 is further fit to the opening of the first housing 14 to firmly hold the sounding plate 11 between the first and second housings 14 and 15. A number of sound passing holes 161, 162, . . . , are formed in the major surface of the second housing 15. The second housing 15 also contains an air layer 17 confined therein. Vibration of the sounding plate 11 acts on the air layer 17 to generate a sound. The sound generated is radiated to the exterior through the sound passing holes 161, 162, . . . .

The first housing 14 is provided at the bottom adjacent a sound drive circuit 18. A sound drive signal is supplied from the sound drive circuit 18 to the sounding plate 11 through a pair of lead wires 19 and 20.

FIG. 2 shows a configuration of the sound drive circuit 18. An oscillating circuit 21 operates as a signal source and oscillates to produce a signal, which in turn is amplified by an amplifier circuit 22. The amplified signal is boosted by a boosting transformer 23 and then drives a sounding device 24 made up of the sounding plate 11.

In designing the sound generating apparatus thus arranged, particularly in designing the sound resonance, the second resonance frequency $f_p$ of the sounding plate 11, the diameter $2a$ of each sound passing hole 161, 162, . . . of the second housing 15, the number n of the holes, the length l of the hole, and a volume V of the air layer 17 are appropriately selected using known formulae. For example, the length l of the hole is determined by the thickness (2 mm) of the second housing 15. In order to obtain a satisfactorily large sound pressure, it is necessary to select relatively large areas for each hole 161, 162, . . . to obtain a satisfactory amount of the volume V.

In the example shown in FIG. 1, for tuning a sound frequency $f_p$ at 1550 Hz, the diameter $2a$ of each hole is 4.8 mm, the number of holes is 24, the volume V is 90 cc, and the second housing's depth h=15 mm. In this case, the amplifying effect is approximately 8 dB.

In the sound generating apparatus thus arranged, the frequency response is configured such that the smaller the low frequency sound pressure, which becomes the fundamental frequency, the smaller the amplifying effect. Therefore, the second-order resonance characteristic mainly contributing to the sound pressure is too sharp. The result is that the sound generated is loud, noisy, and high-pitched. Thus, the sound generating apparatus cannot generate a gentle or soft sound. In this respect, the sound generating apparatus provides a poor tone.

As a means for widening the width of the peak of the resonance, Utility Model Disclosure No. 58-40717 proposes an arrangement in which two diaphragms with different frequencies are arrayed in parallel. Such an arrangement, however, has no means to cope with phenomena peculiar to an acoustic oscillation of low frequencies and also no means which effectively amplifies the sound generated from a couple of sounding plates. For this reason, it was very difficult to obtain a sounding characteristic satisfactory for the alarm sounding device of the automobile with the prior art sound generating apparatus.

SUMMARY OF THE INVENTION

Accordingly, an object of the present invention is to provide a sound generating apparatus using a piezoelectric element which can provide a sound pressure high enough to drive an alarm sounding device for use with an automobile and which can generate a sound that is soft but effective for alarm sounding.

Another object of the present invention is to provide a small sound generating apparatus with a sound amplifying effect large enough to provide adequate sound pressure.

Another object of the present invention is to provide a high quality sound for an automobile alarm sound device, by providing a good response particularly in low frequencies and a high quality tone of a sound.

A sound generating apparatus according to the present invention has a sounding member. The sounding member includes first and second sounding plates arrayed in parallel with each other, and each sounding plate includes a diaphragm laminated with a piezoelectric element. The outer peripheral portions of the first and second sounding plates are united by a ring to form an air chamber therebetween. The sounding member is mounted to a housing such that air layers are formed on the surfaces of the first and second sounding plates such that the air layers communicate with each other at the outer periphery portions of the sounding members.

In the sound generating apparatus thus arranged, the sounding member has a substantially hermetically sealed air chamber formed between the first and second sounding plates. Because of this feature, it is possible to effectively increase the sound pressure level in low frequencies of 800 Hz or less. Therefore, the sound generated is relatively soft and low-pitched, not high-pitched and noisy. Further, front and rear air chambers are formed on both sides of the sounding member, and both the chambers communicate with each other by a ring-like sound path. This feature increases the sound pressure level in high frequencies of 800 Hz or more. Thus, the sound generating apparatus has an increased pressure level in both high and low frequencies. Consequently, a sound pressure increase in low frequencies, the realization of which was difficult with the prior art technique, is effectively attained. Therefore, the sound generating apparatus according to the present invention is very useful when it is applied to the alarm sounding device of an automobile.

DETAILED DESCRIPTION OF THE PREFERRED EMBODIMENTS

Figure 3:
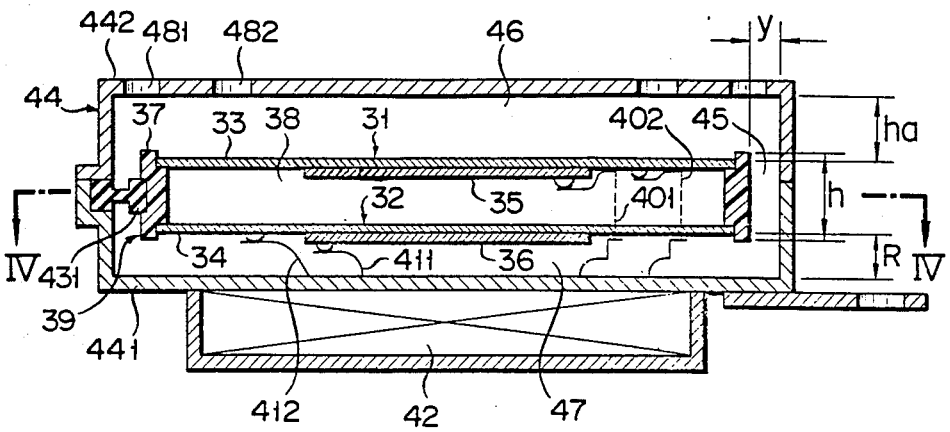
FIG. 3 is a cross-sectional view of a sound generating apparatus which is a first embodiment of the present invention.
Figure 4:
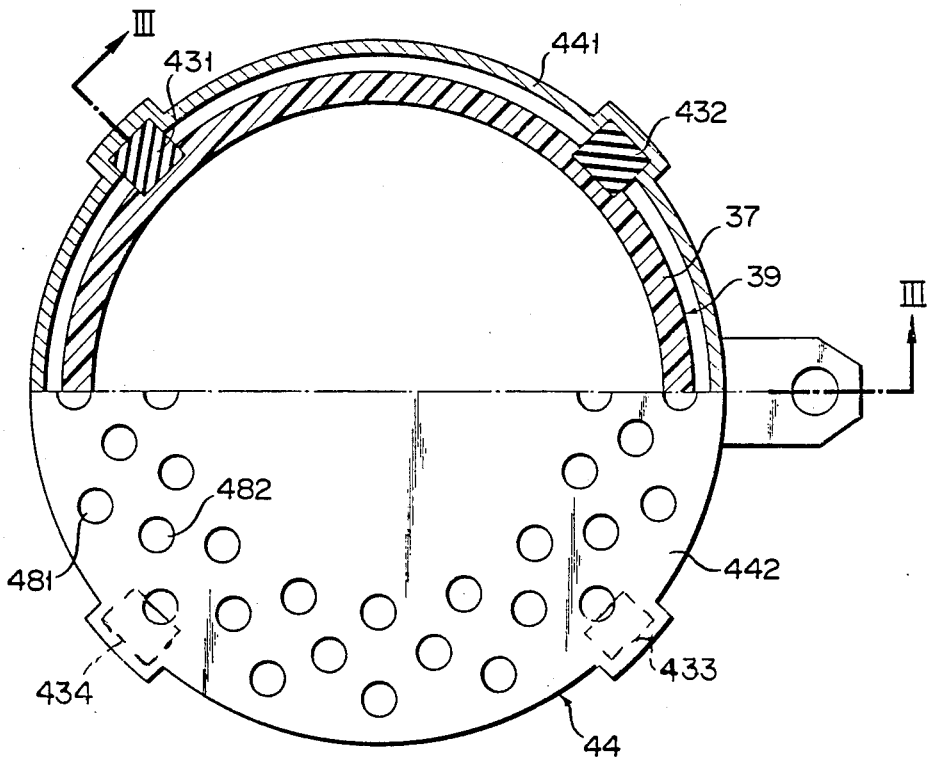
FIG. 4 is a front view of the sound generating apparatus of FIG. 3 along line IV—IV.

In a first embodiment of a sound generating apparatus, shown in FIGS. 3 and 4, first and second sounding plates 31 and 32 are arrayed opposite and parallel to each other. The first and second sounding plates 31 and 32 are respectively made up of metal diaphragms 33 and 34 shaped like thin discs with thin disc-like piezoelectric elements concentrically laminated thereon. The piezoelectric elements 35 and 36 have diameter-to-thickness relationships of "42 mm×0.3 mm" and "48 mm×0.3 mm", respectively. The diaphragm 33 is made of KOVAR (trade name standing for a high nickel alloy made by Nihon Kougyo Co.), and the diaphragm 34 is made of brass. The diaphragms 33 and 34 both have a diameter-to-thickness relationship of "90 mm×0.2 mm".

The peripheral portions of the first and second sounding plates 31 and 32 are mounted on a ring 37 made of synthetic resin. An air chamber 38 is defined by the first and second sounding plates 31 and 32 and ring 37. The sounding plates 31 and 32, together with the air chamber 38, make up a sounding member 39.

Pairs of lead wires 401 and 402, and 411 and 412 are respectively connected to the sounding plates 31 and 32 to feed drive current thereto. These lead wires are, in turn, connected in parallel to a drive circuit 42. The pair of lead wires 401 and 402 connected to the first sounding plate 31 is set in and guided by grooves (not shown) of the ring 37 into the drive circuit 42.

The ring 37 is supported by four supporting members 431 to 434, each made of rubber. The supporting members 431 to 434 (snown in FIG. 4) are buried in depressions on the periphery of the ring 37 and mounted to the inner wall of a housing 44 so as to permit the sounding member 39 to be resiliently supported in the housing 44.

The housing 44 is composed of a first housing 441 as a main frame and a second housing 442 which, together with the sound generating apparatus assembly, is fitted into the opening of the first housing 441 so as to close the opening. More specifically, the supporting members 431 to 434 are fitted into four depressions at the opening of the first housing 441 and firmly held in place by the second housing 442.

The ring 37 forming the sounding member 39 is 93 mm in the outer diameter. The inner diameter of the housing 44 is 100 mm. As shown in FIG. 3, a sound path 45 with a height h and width y is formed around the entire periphery of the ring 37. A front air layer 46 with a thickness ha of 11 mm is formed between the first sounding plate 31, and the bottom of the second housing 442. A rear air layer 47 with a thickness R of 5 mm is formed between the sounding plate 32 and the first housing 441.

Sound passing holes 481, 482 . . . , are formed on the bottom side of the second housing 442, which serves as the front side of the sound generating apparatus. These holes each have a 4.8 mm diameter and are distributed on the peripheral portion of the bottom side of the second housing 442. In the sound generating apparatus thus arranged to create a low frequency resonance, it is known that the vibrating portion has a large diameter and thickness and that its peripheral portion is fixed. In the case of a sound generating apparatus having the dimensions as mentioned above, the first-order resonance frequencies of the first and second sounding plates 31 and 32 are approximately 400 Hz and 500 Hz, respectively. In addition, the inventors have found in relation to such a sound generating apparatus that the air chamber 38 defined by the first and second sounding plates 31 and 32 has a great sound amplifying effect when the diaphragm is thick, large in diameter, and low in vibrating frequency.

Let us consider the amplifying effect of the first-order resonance sound pressure in such a sound generating apparatus. An acoustic wave radiated from the rear side of the first sounding plate 31, which is out of phase with respect to that from the obverse side, is cut by the second sounding plate 32. The second sounding plate 32 thus prevents acoustic wave cancellation resulting from diffraction of the acoustic wave. Assume, for example, that the second sounding plate 32 is not used in the apparatus under discussion. The antiphase acoustic wave from the rear side of the sounding plate 31 would pass through the sound path 45, thus interfering with the sound radiated from the obverse side of the first sounding plate 31 and neutralizing the acoustic waves. In the present invention, on the other hand, since the air chamber 38 is hermetically sealed, the oscillation occurring therein interacts with the interior air, and the acoustic energy is thereby amplified. The first sounding plate 31 similarly acts on the second sounding plate 32. Therefore, the effect of the air chamber 38 on the sound pressure is as illustrated in FIG. 5.

Figure 5:
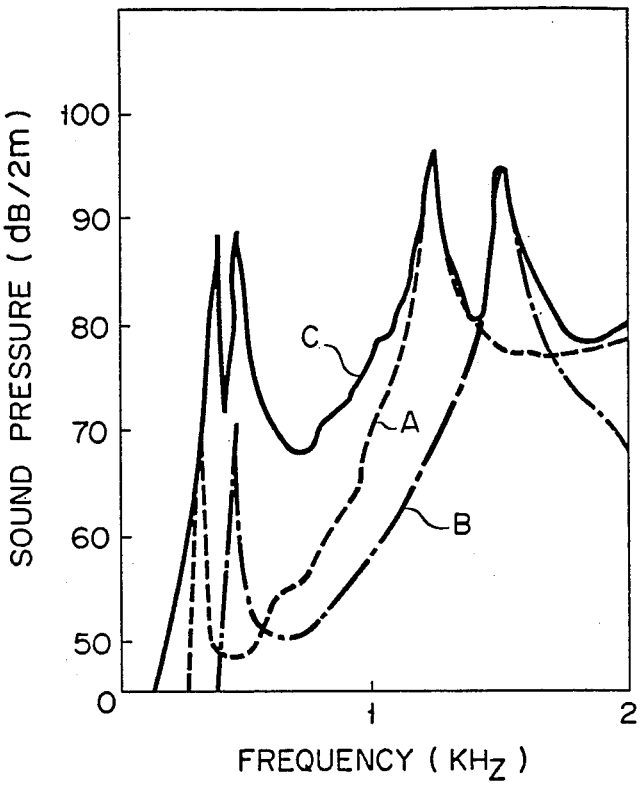
FIG. 5 shows curves explaining the amplifying effect in the air chamber of the FIG. 3 embodiment.

In FIG. 5, curves A and B respectively show the oscillating frequency characterstics for a sinusoidal wave input when only the first or second sounding plate 31 or 32 is used. Curve C shows an oscillating frequency for a sinusoidal wave input when the first and second sounding plates 31 and 32 are used in combination. As seen from FIG. 5, the sound pressure of curve C is superior to that of the curves A and B by about 15 dB, thereby improving the amplifying effect. The data plotted in FIG. 5 was collected with the sounding member 39 taken out of the housing 44.

Thus, in the sound generating apparatus mentioned above, the air chamber 38 sandwiched by the first and second sounding plates 31 and 32 is used for acoustic amplification, and it has a special effect when the resonance frequencies of the first and second sounding plates 31 and 32 are about 800 Hz or less.

Let us consider now the second-order resonance operation. The second-order resonance frequencies of the first and second sounding plates 31 and 32 are approximately 1,250 Hz and 1,550 Hz, respectively. In the sound generating apparatus as mentioned above, the resonance takes place mainly between the sound path 45 and the rear air chamber 47. The resonance frequency is about 1,400 Hz, which is approximate to the mid-frequency between the second-order frequencies of the first and second sounding plates 31 and 32. The width y and the length h of the sound path 45 are appropriately selected to tune the resonance frequency to such a frequency. By providing a sound path 45, whose length corresponds to the width of the ring 37, for example, a satisfactory second-order amplifying effect can be obtained even if the volume V of the front air chamber 46 (with thickness ha) is small.

Figure 6:
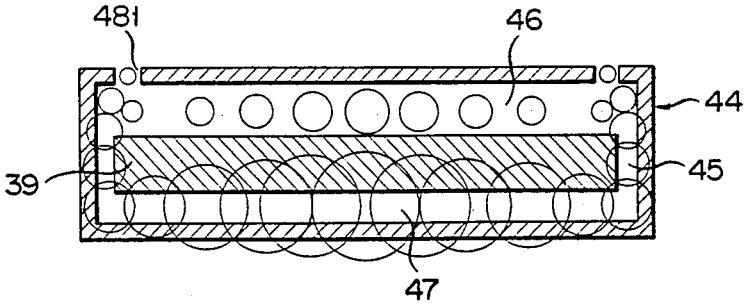
FIG. 6 is a diagram illustrating the resonance mode of the sound generating apparatus.

The resonance mode of the sound generating apparatus of the present invention was analyzed by a finite element simulation technique. The result of the analysis is shown in FIG. 6. In the figure, the size of each circle indicates the magnitude of the sound pressure (resonance mode) at the center of each circle. As shown, the front air layer 46 resonates with the rear air layer 47 through the interaction available through sound path 45. Accordingly, the second-order resonating sound pressure of the first sounding plate 31 is amplified by this mutual excitation. To enhance this effect, in the present embodiment the front air layer 46 is thicker than the rear air layer 47. The sound passing holes 481, 482, . . . are arrayed or distributed as close to the outer periphery of the second housing 442 as possible. Such an arrangement of the sound generating apparatus enhances the amplifying effect of the sounding plate 31 as shown in FIG. 7.

Figure 7:
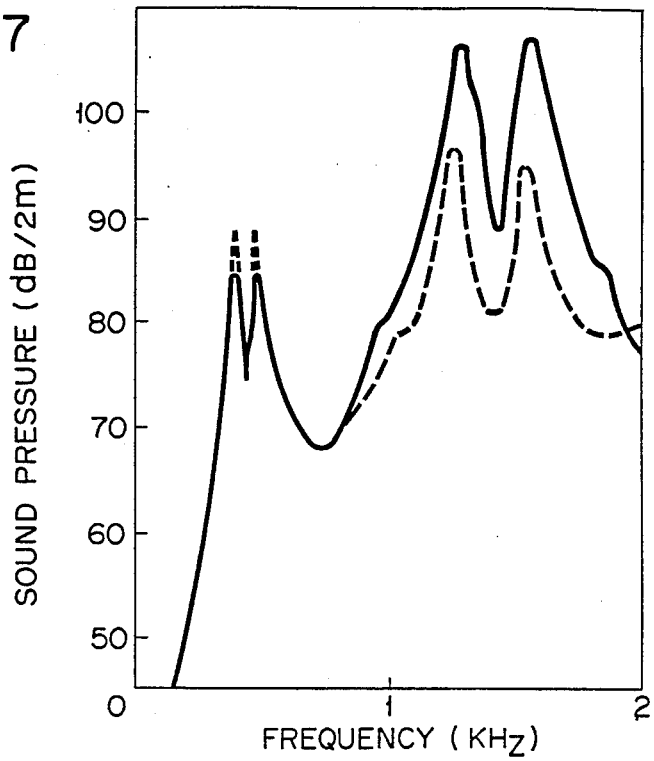
FIG. 7 shows curves illustrating the resonance amplifying effect of the sound generating apparatus.

In FIG. 7, a continuous curve indicates the resonance amplifying effect of the present embodiment, while a broken curve indicates the resonance amplifying effect when the housing 44 is removed. Each of the curves shown in FIG. 7 corresponds to the curve as indicated by the continuous line in FIG. 5. The curves plotted in FIG. 7 are based on the frequency output for a sinusoidal wave input. As shown, because of the presence of the housing 44 enclosing sound path 45, the resonance sound pressures of the first and second sounding plates 31 and 32 are both amplified by about 8 dB or more.

Figure 1:
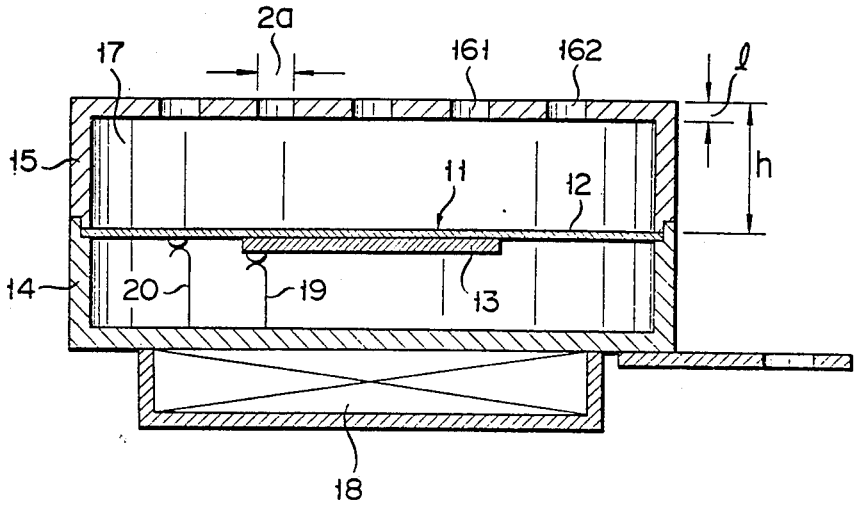
FIG. 1 PRIOR ART
FIG. 1 is a cross-sectional view of a conventional sound generating apparatus.
Figure 2:
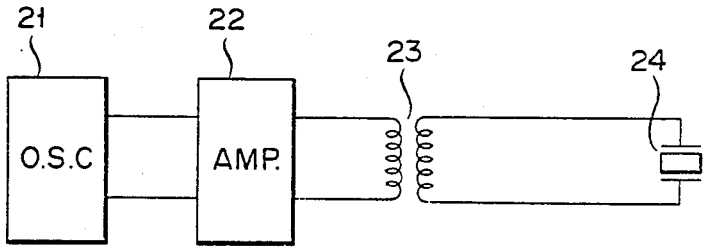
FIG. 2 PRIOR ART
FIG. 2 shows a configuration of a drive circuit of the sound generating apparatus of FIG. 1.

In the prior art sound generating apparatus as shown in FIG. 1, a resonance chamber is provided for a single sounding plate. Therefore, if two sounding plates are used, two resonance chambers are needed, thereby doubling the size of the sound generating apparatus. In the sound generating apparatus according to the present invention, on the other hand, the total thickness of the front and rear air layers 46 and 47 is 15 mm. Thus, with the thickness of the air layer comparable with that when a single sounding plate is used, the acoustic waves generated by the two sounding plates 31 and 32 can be amplified satisfactorily without unnecessarily increasing the size of the sound generating apparatus.

Figure 8:
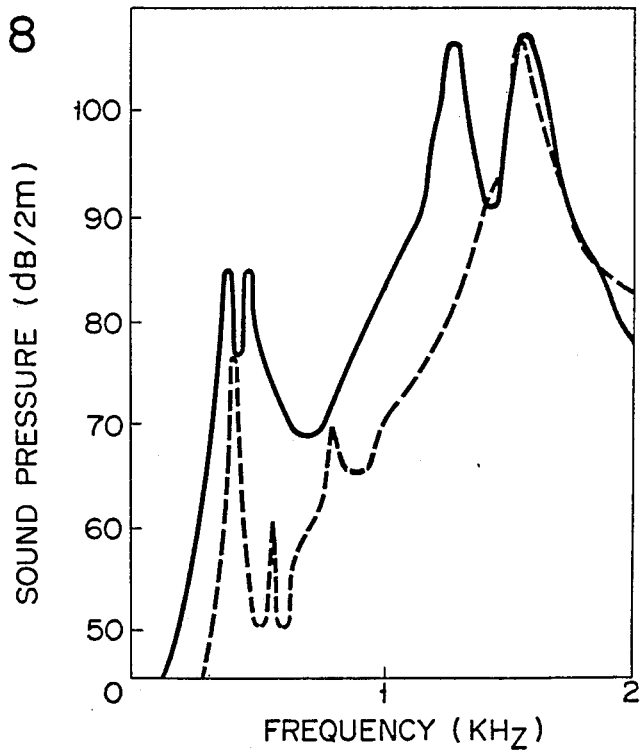
FIG. 8 shows curves comparing frequency responses of the first embodiment and the conventional sound generating apparatus.

FIG. 8 comparatively shows frequency responses of the present embodiment and of the prior art sound generating apparatus. In the figure, a continuous line indicates the frequency response of the present embodiment shown in FIG. 3 and a broken line indicates the frequency response of the prior art of FIG. 1. As seen from FIG. 8, although it is comparable in size with the prior art of FIG. 1, the sound generating apparatus of FIG. 3 has good response in low frequencies which form the fundamental frequency and a broad band-width of the second-order resonance serving as a sound pressure component. For example, if the drive circuit 42 produces an oscillating wave signal containing components of about 400 Hz, about 500 Hz, about 1200 Hz and about 1500 Hz, a soft and rich tone is generated. Such a sound is desirable for the alarm sound of an automobile.

The supporting members 431, 432, 433 and 434 for supporting the sounding member 39 will now be described. In the first-order resonance mode of each of the first and second sounding plates 31 and 32, which cooperatively form the sounding member 39, no oscillation node resides on the peripheral portion thereof, and the vibration of the ring 37 is large. Therefore, if the ring 37 is completely fixed, the vibration at the supporting portion is restrained so that a trembling sound is generated. To avoid such a sound, the supporting members 431, 431, 433 and 434 are preferably made of resilient material, such as rubber, to absorb the vibration.

Figure 9:
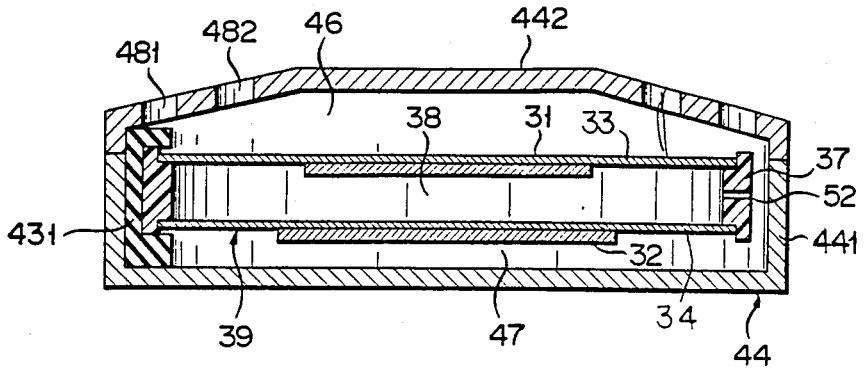
FIGS. 9 to 12 respectively are cross-sectional views of the second to fifth embodiments of the present invention.

The supporting members 431, 432, 433 and 434 for supporting the sounding member 39 are projected from the first housing 441 into a part of the ring 37. Alternatively, the supporting members 431, 432, 433 and 434 may form a U cross section. In supporting the sounding member 39, housing 441 receives the entire width of the ring 37, as shown in FIG. 9. In other words, the ring 37 is fitted into the supporting members 431, 432, 433 and 434, which are made of sponge-like rubber. In this case, the periphery portion of the bottom plate portion of the second housing 442 is tapered downwardly, to securely hold the supporting members 431, 432, 433 and 434. If necessary, a hole 52 with a diameter, for example, of 1.5 mm, may be formed in the side wall of the ring 37, providing that the amplifying effect of the internal air chamber 38 is not damaged. With this hole, it is possible to avoid a change in characteristics due to a pressure difference in the air chamber 38. In addition, sound passing holes may be formed in the side wall of the housing 44.

Figure 10:
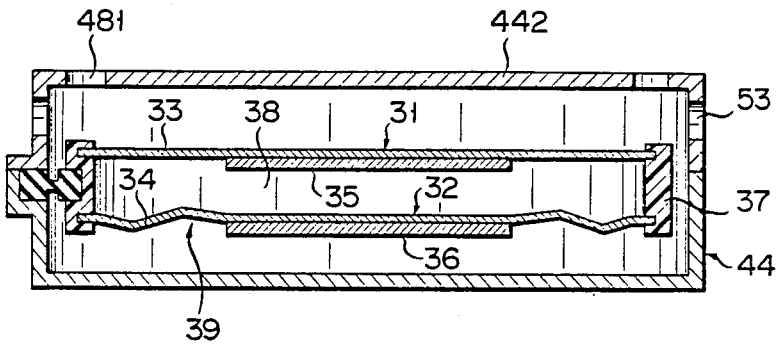

To obtain differenct resonance frequencies of the first and second sounding plates 31 and 32, the sounding plates 33 and 34 are made of the same material, for example, brass, but are shaped differently from each other, as shown in FIG. 10. The peripheral portions of the diaphragms 33 and 34 may be fixed by welding or caulking.

Figure 11:
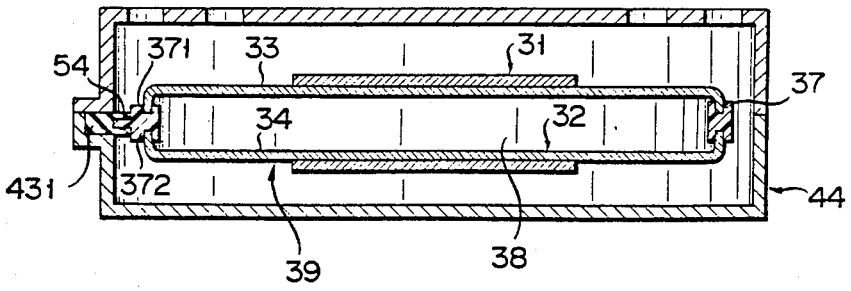

While in the above-mentioned embodiment the sounding member 39 is made up of two separate diaphragms 33 and 34, the structure of the sounding member 39 is not limited as such. For example, as shown in FIG. 11, the peripheral portions of the diaphragms 33 and 34 are each bent to form a tray. When assembled, the tray-shaped diaphragms 33 and 34 are coupled at the openings with each other. The peripheral portions of the diaphragms 33 and 34 are set into the grooves 371 and 372 formed in the ring 37. As for the structure of the supporting portion of the sounding member 39, a collar flange 54 is projected into the outer periphery portion of the ring 37. Furthermore, a number of sound passing holes formed in the second housing may be replaced by slits.

Figure 12:
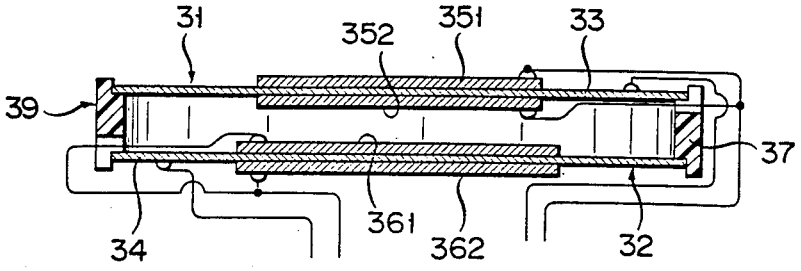
Figure 13:
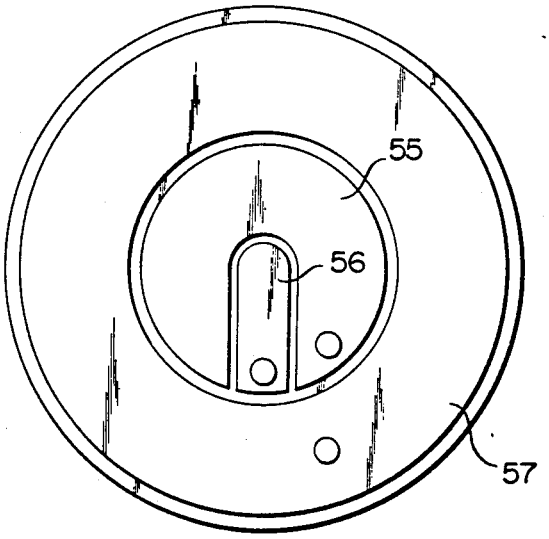
FIG. 13 shows another configuration of the electrode arrangement for a piezoelectric element.

In the above-mentioned embodiments, as for the first and second sounding plates 31 and 32, it is one side of the diaphragm to which the piezoelectric element is attached. However, a couple of piezoelectric elements may be attached to both sides of the diaphragm. That is to say, each of the first and second sounding plates 31 and 32, which form the sounding member 39, may be of bimorphic structure. This is realized by the embodiment shown in FIG. 12. As shown, a pair of piezoelectric elements 351 and 352 are attached to both sides of the first diaphragm 33. Another pair of piezoelectric elements 361 and 362 are attached to both sides of the second diaphragm 34. In this case, these pairs of piezoelectric elements 351 and 352, and 361 and 362, attached respectively to the diaphragms 33 and 34, may be connected in parallel and driven by a single drive circuit. If necessary, they may be driven by two separate drive circuits with appropriate connections. When employing such an arrangement, however, an electrode 55 is formed on the surface of the piezoelectric element, as shown in FIG. 13, and a subelectrode 56 divided from the electrode 55, is formed on the piezoelectric element. By using these electrodes, the electrodes 55 and 56 and an electrode 57 on the diaphragm, a self-excitation drive-signal generating means may be formed.

Figure 14:
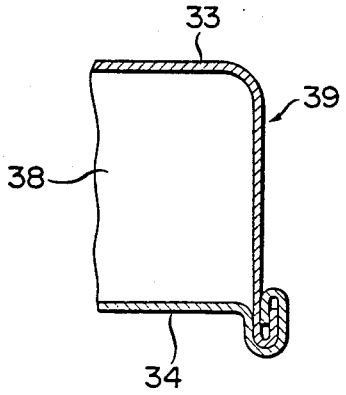
FIGS. 14 and 15 are sectional views of a sounding member comprising first and second diaphragms.

In the sound generating apparatus shown in FIG. 3, the ring 37 is used for mounting the first and second sounding plates 31 and 32. Alternatively, the outer peripheral portions of the first and second diaphragms 33 and 34 are directly in contact with each other to form an air chamber therebetween. To be more specific, as shown in FIG. 14, one of the diaphragms 33 and 34 is bent at one outer peripheral portion. The bent peripheral portion of the diaphragm 33 is in contact with that of the other diaphragm 34, and these peripheral portions are rolled for caulking, as shown in FIG. 14. In this way, an air chamber 38 is formed between the diaphragms 33 and 34.

Figure 15:
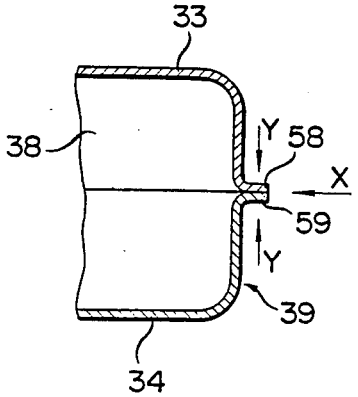

Another example is shown in FIG. 15. In that figure, the outer peripheral portions of the first and second diaphragms 33 and 34 are bent so as to have flanges 58 and 59, as shown. In coupling those diaphragms, these flanges are laid one on top of the other. The superposed flanges are made into a unit by electrical spot welding in the directions Y—Y. Laser welding or argon welding may be used in the direction X.

Figure 16:
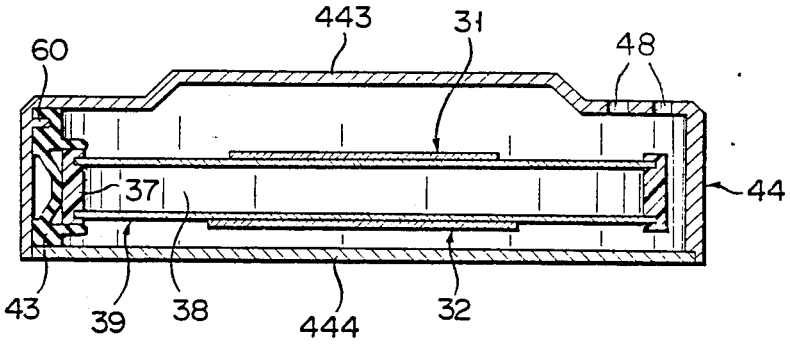
FIG. 16 is a cross-sectional view of a sixth embodiment of a sound generating apparatus according to the present invention.
Figure 17:
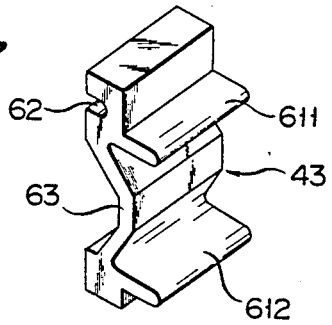
FIG. 17 shows an example of a supporting member used in the FIG. 16 embodiment.

FIG. 16 shows another embodiment of a sound generating apparatus according to the present invention. As shown, the housing 44 is comprised of a main body 443 with a sound passing hole 48 and a cover 444, which is set on the main body so as to close an opening of the main body 443. A projection 60, which is used as a stopper, is formed inside the main body. A supporting member 43 is supported by the projection 60 and the supporting member 43 securely holds the ring 37 of the sounding member 39. A typical example of the supporting member 43 thus used is illustrated in FIG. 17. As shown, the supporting member 43 is provided with a pair of legs 611 and 612 for holding the ring 37 and a hole 62 for receiving the projection 60. For holding the sounding member 39, an outwardly curved portion 63 is formed to press against the side wall. The ring 37 is stably held by the curved portion 63.

What is claimed is:

1. A sound generating apparatus with a sealed air chamber between two sounding plates, comprising:

means for defining said sealed air chamber including:

a first sounding plate comprising a first diaphragm and a first piezoelectric element attached to said first diaphragm, said first sounding plate having a first resonance frequency characteristic, and a second sounding plate, at least a portion of said second sounding plate being parallel to at least a portion of said first sounding plate, comprising a second diaphragm and a second piezoelectric element attached to said second diaphragm, said second sounding plate having a second resonance frequency characteristic;

a housing for accommodating said defining means, said housing having a front surface and a bottom surface opposed, respectively, to outer side surfaces of said first and second sounding plates;

a front air chamber formed between said first sounding plate and said housing;

a rear air chamber formed between said second sounding plate and said housing;

a ring-like sound path formed between the outer peripheries of said first and second sounding plates and the inner peripheries of said housing, said front and rear air chambers communicating with each other through said sound path;

sound passing means including a multiplicity of holes formed in the front of said housing, said front air chamber communicating with the atmosphere through said sound passing means; and a drive circuit for applying an oscillating voltage signal to said first and second piezoelectric elements, respectively, to thereby oscillate said first and second diaphragms such that said first plate causes a resonating sound pressure to be communicated through said sealed air chamber to said second plate, thereby causing said second plate to resonate so as to cause additional resonating sound pressure to pass through said ring-like sound path in order to amplify said resonating sound pressure.

2. An apparatus according to claim 1, in which said first and second resonance frequency characteristics are different from each other.

3. An apparatus according to claim 2, in which said first and second diaphragms are made of different materials.

4. An apparatus according to claim 2, in which said first and second diaphragms are different in shape.

5. An apparatus according to claim 1, in which said sealed air chamber is perfectly hermetically sealed.

6. An apparatus according to claim 1, in which said sound passing means is composed of a plurality of small holes most of which are located near the outer periphery of the front of said housing.

7. An apparatus according to claim 1, in which said front air chamber is thicker than said rear air chamber.

8. An apparatus according to claim 1, in which said drive circuit generates a low frequency component of 800 Hz or less and a frequency component containing frequencies three times those in said low frequency component.

9. An apparatus according to claim 8, in which said drive circuit generates an oscillating signal containing frequency components of about 400 Hz, 500 Hz, 1200 Hz, and 1500 Hz.

10. An apparatus according to claim 1, in which said first and second resonance frequency characteristics of said first and second sounding plates respectively include first-order resonance frequencies of 800 Hz or less which are different from each other, and second-order resonance frequencies approximately three times said first-order resonance frequencies, respectively.

11. An apparatus according to claim 10, in which the first-order frequencies of said first and second sounding plates are approximately 400 Hz and 500 Hz, respectively.

12. An apparatus according to claim 1, in which said first and second resonance frequency characteristics of said first and second sounding plates respectively include first-order resonance frequencies of 800 Hz or less which are different from each other, and second-order resonance frequencies approximately three times said first-order frequencies, respectively, and in which said ring-like sound path and said rear air chamber are designed to resonate at a frequency approximate to a mid-frequency between the second-order resonance frequencies of said first and second sounding plates.

13. An apparatus according to claim 1, in which said sound generating apparatus is an electric type alarm sound generator for use in an automobile.

14. An apparatus according to claim 1, in which said defining means further includes a ring coupled to outer peripheral portions of said first and second sounding plates, said sealed air chamber being defined by said ring and said first and second sounding plates.

15. A sound generating apparatus with a sealed air chamber between two sounding plates, comprising:

means for defining said sealed air chamber including:

a first sounding plate comprising a first diaphragm and a first piezoelectric element attached to said first diaphragm, said first sounding plate having a first resonance frequency characteristic, and a second sounding plate, at least a portion of said second sounding plate being parallel to at least a portion of said first sounding plate, comprising a second diaphragm and a second piezoelectric element attached to said second diaphragm, said second sounding plate having a second resonance frequency characteristic;

a housing for accommodating said defining means, said housing having a front surface and a bottom surface opposed, respectively, to outer side surfaces of said first and second sounding plates;

a front air chamber formed between said first sounding plate and said housing;

a rear air chamber formed between said second sounding plate and said housing;

a ring-like sound path formed between the outer peripheries of said first and second sounding plates and the inner peripheries of said housing, said front and rear air chambers communicating with each other through said sound path;

sound passing means including a multiplicity of holes formed in the front of said housing, said front air chamber communicating with the atmosphere through said sound passing means; and a drive circuit for applying an oscillating voltage signal to said first and second piezoelectric elements, respectively, to thereby oscillate said first and second diaphragms such that said first plate causes a resonating sound pressure to be communicated through said sealed air chamber to said second plate, thereby causing said second plate to resonate so as to cause additional resonating sound pressure to pass through said ring-like sound path in order to amplify said resonating sound pressure, said sealed air chamber communicating with a space formed outside said sealed air chamber through a small hole, said small hole controlling the pressure within said sealed air chamber so that the sound amplifying effect of said sealed air chamber is not damaged.

* * * * *